United States Patent [19]

Rybka et al.

[11] Patent Number: 4,676,339

[45] Date of Patent: Jun. 30, 1987

[54] SELF-CONTAINED-AERIAL-MAINTENANCE PLATFORM

[75] Inventors: John J. Rybka; Robert C. Pegnam, both of Seattle, Wash.

[73] Assignee: NORPAC Engineering, Inc., Seattle, Wash.

[21] Appl. No.: 821,845

[22] Filed: Jan. 23, 1986

[51] Int. Cl.[4] ..... B66F 11/04; E04G 3/10; E04G 3/16

[52] U.S. Cl. ..... 182/2; 182/36; 182/63; 182/142

[58] Field of Search ..... 182/2, 142, 150, 128, 182/63, 36

[56] References Cited

U.S. PATENT DOCUMENTS

| | | | |
|---|---|---|---|
| 2,927,705 | 3/1960 | Girardi | 182/2 |
| 3,306,396 | 2/1967 | Goss | 182/2 |
| 3,866,713 | 2/1975 | Carpenter | 182/2 |
| 3,891,051 | 6/1975 | Takenouchi | 182/2 |
| 3,994,365 | 11/1976 | Petermann | 182/2 |
| 4,058,184 | 11/1977 | Stuart | 182/128 |
| 4,165,799 | 8/1979 | Munoz | 182/2 |
| 4,546,852 | 10/1985 | Martin | 182/142 |

*Primary Examiner*—Reinaldo P. Machado
*Attorney, Agent, or Firm*—Sachs & Sachs

[57] ABSTRACT

An apparatus for maintaining and inspecting a dockside container crane which includes at least one aerial work platform unit rigidly attached to one end of an ISO container. A spreader attached to the crane is used to grasp the ISO container for permitting the crane to lift the apparatus to an operating position, where an inspector or repairman manipulates controls on a work platform to operate a turret and telescopic boom, connected between the work platform and the turret, to position the work platform for inspecting or servicing some portion of the crane.

15 Claims, 4 Drawing Figures

SELF-CONTAINED-AERIAL-MAINTENANCE PLATFORM

FIELD OF THE INVENTION

The field of the present invention relates to apparatus for inspecting and maintaining cranes, and more specifically relates to such apparatus for inspecting and maintaining dockside container cranes and other large cranes.

BACKGROUND OF THE INVENTION

The inspection, maintenance, and repair of large crane structures such as dockside container cranes for loading and unloading ISO containers from ships is difficult to accomplish. Many areas or portions of the crane struture are relatively inaccessible due to the height of the crane and the absence of safe walkways for gaining access to various portions of the crane structure remote from the ground. Prior attempts at servicing and maintaining such cranes included the use of a scissors lift incorporating platforms for raising and lowering an operator between the ground and portions of the crane to be serviced or inspected. Also, separate aerial cranes have been used to lift a repairman or inspector adjacent to a desired area of a dockside crane requiring maintenance or inspection. These prior methods of inspection and repair have proved to be both costly and unsafe in delivering a worker to an area of a dockside crane to be inspected or repaired.

SUMMARY OF THE INVENTION

To overcome the problems in the prior art of maintaining and inspecting dockside cranes, the present invention includes a modified ISO container having in one embodiment a cantilevered platform rigidly attached to one end of the container. A boom supported work platform is mounted upon the platform for permitting a worker to be lifted to desired horizontal and vertical coordinates within a range relative to some portion of the crane. The positioning range of the work platform is extended, via use of the dockside crane itself to lift the container via a spreader attached to the crane, for positioning the apparatus at a location relative to the crane where the boom lift can be manipulated for further positioning of the work platform adjacent to a portion of the crane to be inspected or repaired.

In another embodiment of the invention, a second cantilevered platform is rigidly attached to the other side of the container, and a second boom lift is mounted upon this second platform for positioning a second aerial work platform at a desired location relative to the crane.

BRIEF DESCRIPTION OF THE DRAWINGS

The invention will now be described by way of example with reference to the accompanying drawings in which.

DESCRIPTION OF THE PREFERRED EMBODIMENTS OF THE INVENTION

Figure 1:
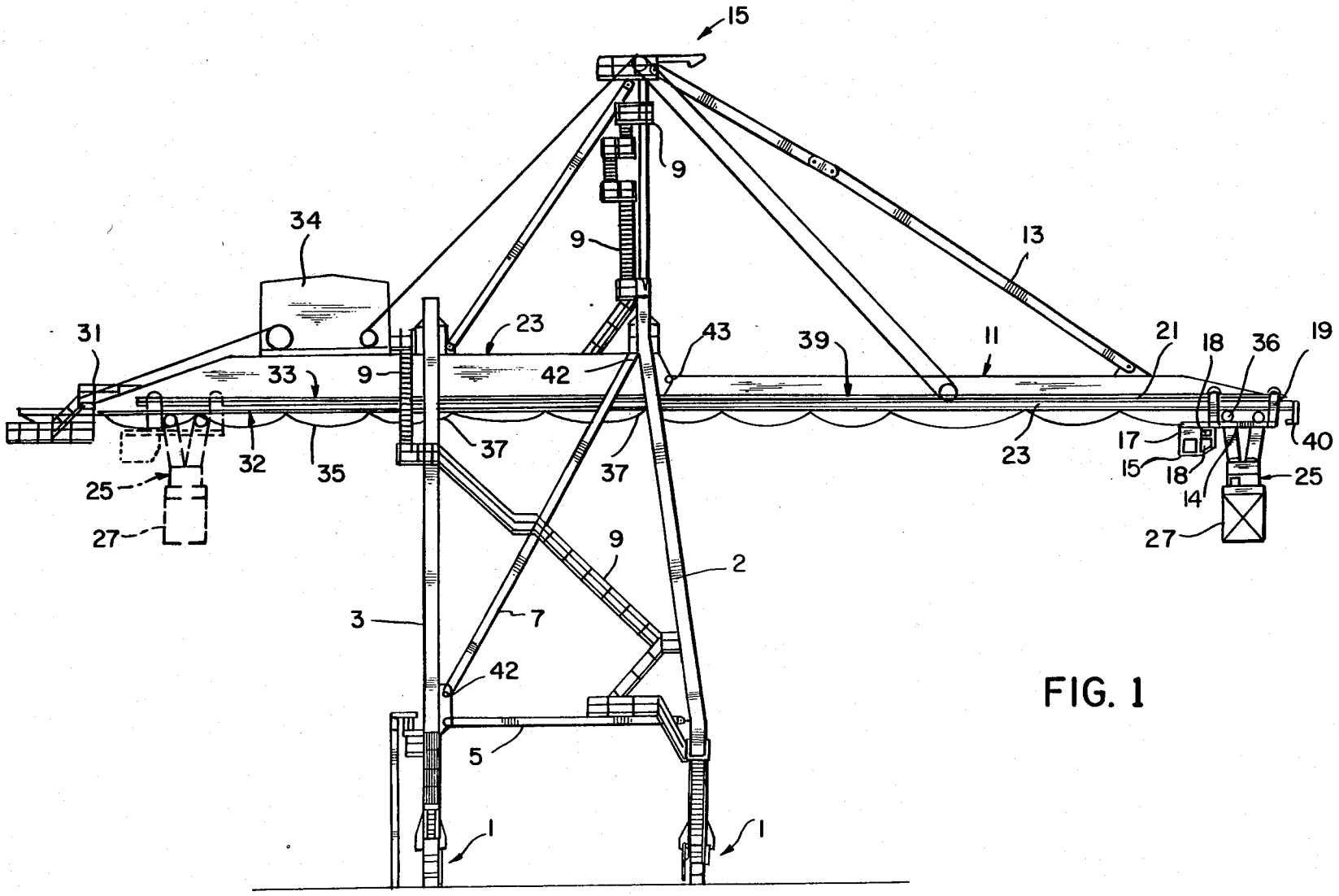
FIG. 1 shows a side view of a typical dockside container crane.
Figure 2:
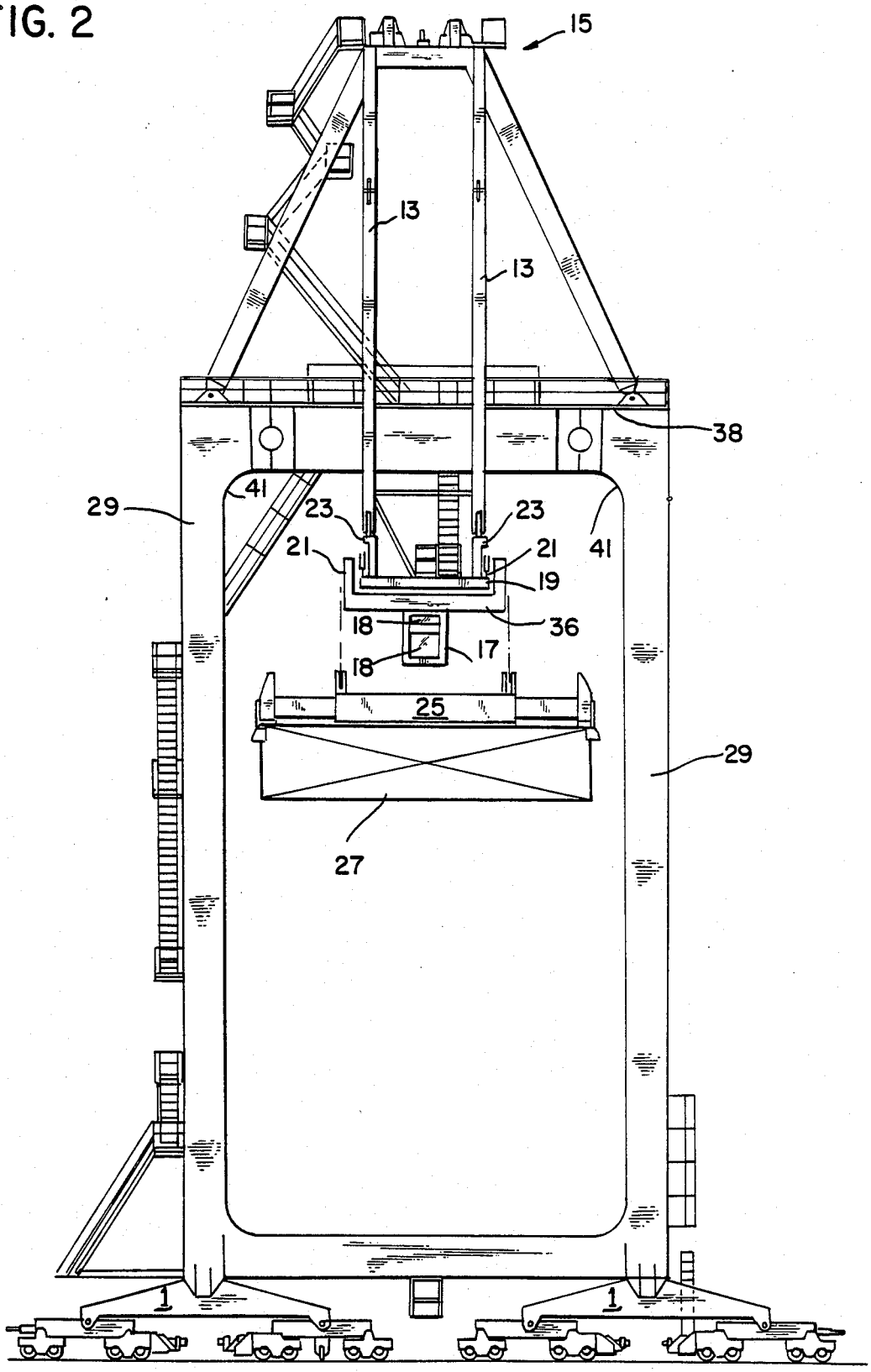
FIG. 2 shows a front view of the typical dockside container crane.

Referring now to the figures, and more particularly to FIGS. 1 and 2 thereof, a conventional dockside container crane well known by the skilled in the art is shown and includes a gantry drive system 1 for positioning the crane; waterside gantry legs 2; landside gantry legs 3; cross beams 5; diagonal beams 7; access ladders and stairs 9; a boom 11; a forestay 13; an apex 15; a cab 17 for the crane operator; a trolley assembly 19; trolley rails 21; trolley girders 23; a spreader assembly 25 for grasping and permitting the crane to lift and move an ISO container 27. The spreader assembly 25, the ISO container 27, and the cab 17 are also shown in phantom at a second location along the boom 11, these being positionable from the illustrated position to the phantom position along the boom 11.

For the sake of simplicity, other portions of the crane have not been specifically labeled with reference numerals for identification, but are well known to these skilled in the art. To give some perspective to the size of the dockside crane, note that the boom 11 is typically over 90 feet from the ground. As will be hereinafter described in detail, some of the various areas of the dockside crane that can be readily inspected and serviced through use of the present invention, shown in FIGS. 1 and 2, include the trolley girders 23 at end ties in area 31; the underside of the trolley girders 23 along 32; the outer sides of the trolley girders 23 along 33; the outer walls of the machinery house 34; the festoon track 35; the leading festoon carriers and pick-up arm 36; the sides and bottoms of the trolley girders splices and their leg connections 37; the undersides of the boom chords 38; the outer sides of the boom chords 39; the underside of the boom tip 40; the corners of the four legs 41; the ends of the main diagonal braces 42; the boom hinge 43; the underside 14 of the trolley assembly 19; the legs 29 and their splices; the underside 15 of the cab 17 and the windows 18 thereof; and so forth. Also, it will be readily apparent that any injured or disabled personnel can readily be retrieved from the machinery house 34 level of the crane.

With further reference to FIG. 1, it should be noted that when the crane is in use the portion of the boom 11 to the right of the gantry legs 2 is typically projecting over water for loading and unloading containers 27 from cargo ships. The trolley assembly 19 is operable for movement along the trolley rail 21 from the right most extreme to the left most extreme as previously described and shown in phantom. Typically, this represents a total travel of about 215 feet. Further, in usual operation, flat bed trucks are driven between the "A" frame legs 3 for loading or unloading ISO containers 27 between the trucks and cargo ships located alongside the dock in the water below the extension of the boom 11.

Figure 3:
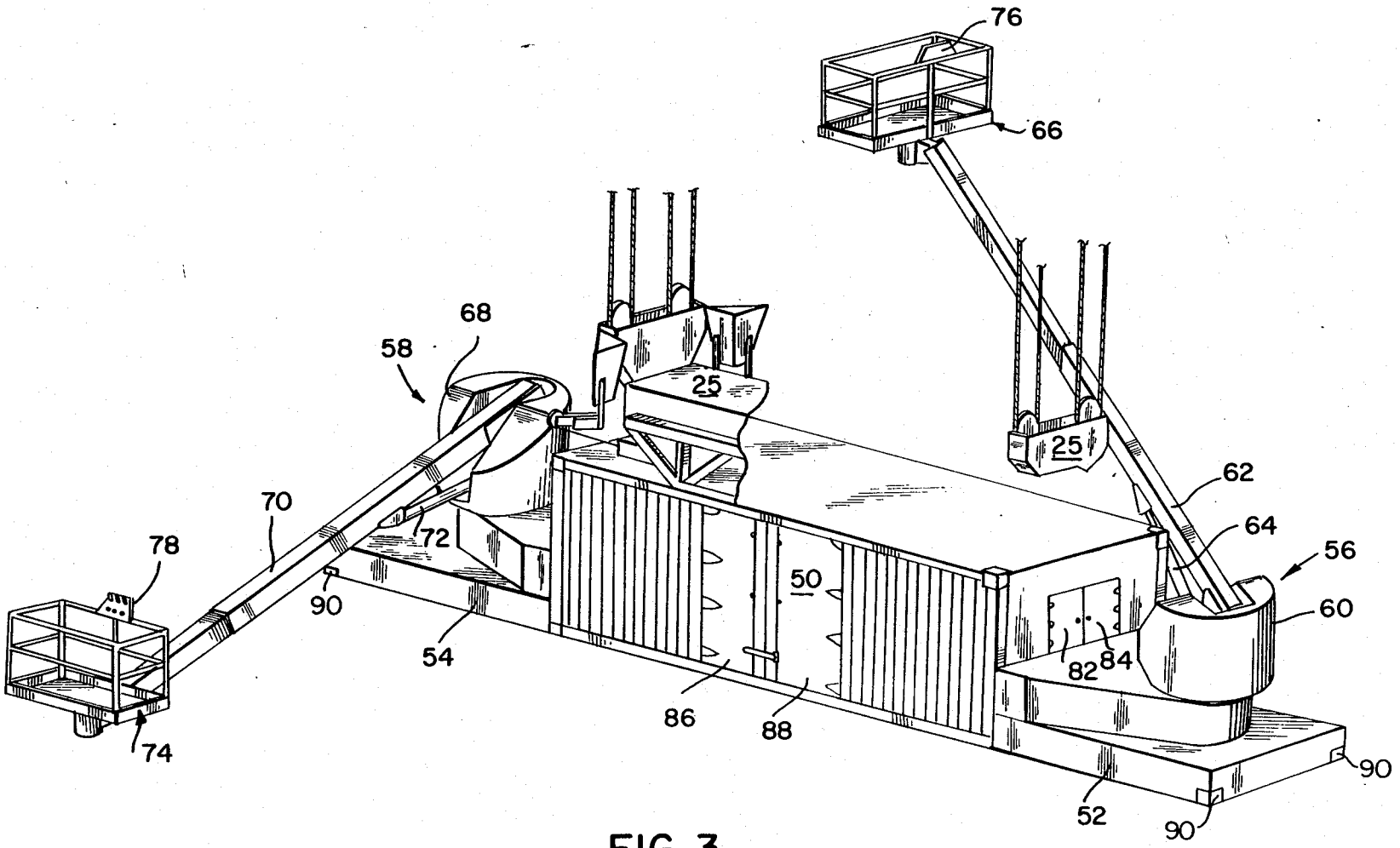
FIG. 3 shows a pictorial diagram of the preferred embodiment of the subject invention.
Figure 4:
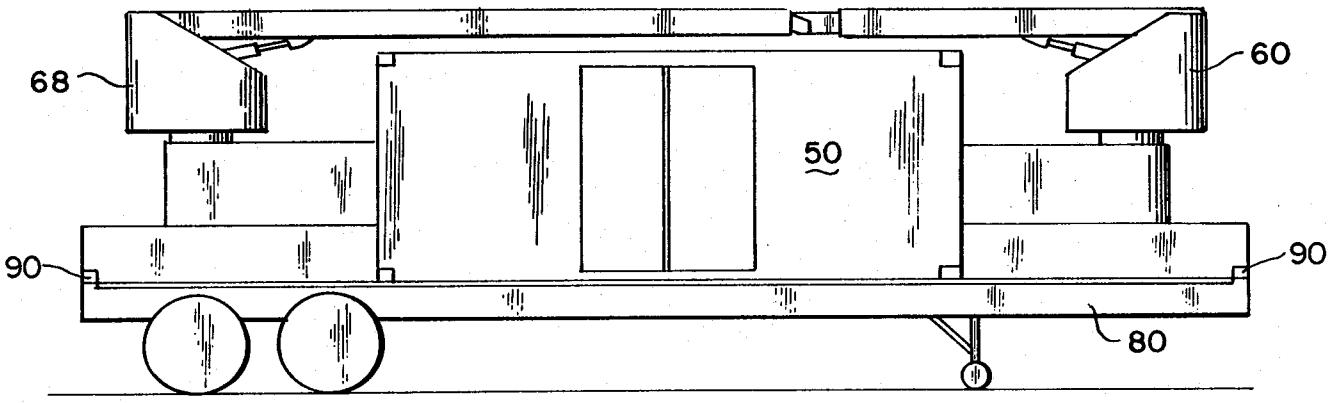
FIG. 4 shows the embodiment of the subject invention of FIG. 3 in a configuration for transport.

As shown in FIG. 3, the preferred embodiment of the present invention includes a conventional 20 foot ISO container 50 which has been modified to include a pair of cantilevered platforms 52 and 54, fixedly secured tot he ends of the container 50, respectively, with boom lifts 56 and 58 mounted upon the platforms 52, 54, respectively. The cantilevered platforms 52 and 54 are fitted with standard ISO sockets 90 for attachment to a 40 foot trailer chassis as shown in FIG. 4. The boom lift 56 includes a rotatable turret 60, a telescopic boom 62, a hydraulic cylinder 64, and a work platform 66 located at the free end of the boom 62 all in conventional operational association. The boom lift 58 similarly includes a rotatable turret 68, a telescopic boom 70, a hydraulic cylinder 72, and a work platform 74 located at the free end of the boom 70, all also connected in conventional operational association.

The work platforms 66 and 74 each include conventional control panes 76 and 78, respectively, for permitting an operator located on the respective work platforms 66 and 74 to operate the turret 60 and 68 and telescopic boom mechanisms 62 and 70 for positioning the respective work platform 66 and 74. A portion of the spreader assembly 25 is shown in engagement with standard locking mechanisms mounted on the ISO container 50 (the locking mechanisms not being shown) for permitting the crane to lift the container 50 along with the previously described aerial work platform mechanisms attached to the container 50. A modified MARK 30 I boom lift mechanism manufactured by Mark Industries, Long Beach, Calif., or a similar unit can be used for providing each one of the aerial work platform mechanisms including the turrets 60 and 68, booms 62 and 70, the hydraulic cylinders 64 and 72, the work platforms 66 and 64, and control panels 76 and 78.

The modified ISO container 50 is used to store necessary equipment for carrying out the inspection and/or repair of a crane, and may include portable air compressors for powering impact wrenches, sand blasters, paint sprayers, and power brushes, power units for non-destructive testing of welds, Oxy-acetylene bottles for burning or heating and straightening damaged structural members, welding machines, and so forth. Also, the aerial work platforms 66 and 74 are detachable from their respective booms 62 and 70, so that the platforms 66 and 74 can be stored during non-use or transportation in the container 50.

FIG. 4 shows a side view of the embodiment of the invention of FIG. 3 configured for transportation on a flat-bed trailer or standard ISO container chassis 80. Another embodiment of the invention includes only one boom lift and work platform, but is otherwise as shown in FIG. 3. Of course, the weight of the alternative embodiment of the invention must be redistributed to insure balancing of the apparatus when it is lifted into the air by the crane as will be described.

In actual operation of the present invention, the crane is operated to secure the spreader assembly 25 to the container 50, via interlocking means now standardized in ISO container technology. The crane is then operated to lift the container 50 with its associated aerial work platforms 66 and/or 74 to an appropriate height and position under the boom 11, for permitting an inspector or repairman standing, for example, on work platform 66 to manipulate the controls on the associated control panel 76 for rotating the turret 60 (within a 280 degree rotation for example), to raise or lower the boom 62 by operation of the hydraulic cylinder 64, and to extend or retract the telescopic boom 62 to a desired position, all for locating the associated aerial platform 66 adjacent to a portion of the crane requiring inspection or maintenance. Similarly, another inspector and/or repairman may be located on work platform 74, this operator manipulating the controls on control panel 78 for operating the telescopic boom 70, turret 68, and hydraulic cylinder 72, for positioning the work platform 74 adjacent another portion of the crane requiring inspection or maintenance.

Clearly, other portions of the crane are accessible via operation of the crane mechanism for repositioning the trolley and perhaps changing the height of the container 50, for permitting the work platforms 66 and/or 74 to be positioned over a range of locations adjacent to portions of the crane also requiring various inspection and maintenance.

As previously mentioned, all support equipment is stored in the container 50, thereby eliminating the need for inspectors or maintenance repair personnel to leave the work area to obtain such equipment. Service ports 82 and 84 are provided on either end of the container 50, for permitting passage of equipment power leads and hoses from the interior of the container 50 to the work platforms 66 and 74.

Other features of the present invention include doors 86 and 88 in container 50, which permit easy access for loading and unloading the container 50. Also, a carbon dioxide fire extinguishing system may be included in the container 50 for the handling of hazardous materials.

The present aerial work platform invention and apparatus provides for relatively ready access to what are normally substantially inaccessible areas of a container crane, as previously indicated, for permitting inspection, non-destructive testing, bolt replacement, welding, general repair and/or replacement, sand blasting, painting, burning, and heat straightening. The present aerial maintenance platform if constructed in accordance with the principles hereof would weigh approximately 36,000 pounds, and provides an envelope configuration that is 40 feet long, 8 feet wide, and 9½ feet high, thereby permitting easy transport on a flat bed trailer. The booms 62 and 70 are rotatable by the turrets 60 and 68, respectively, through a 280 degree rotation. The work platforms 66 and 74 can be elevated, via extension of the booms 62 and 70, respectively, to provide a useful and practical reach horizontal from the center of the crane spreader 25, and vertical from the bottom of the container spreader 25. Also, the turrets 60 and 68 would preferably have a minimal turret tail swing, and the aerial platforms 68 and 74 would preferably include automatic platform leveling mechanisms not described or shown herein.

It will be understood that various changes in the details, materials, arrangements of parts and operational conditions which have been herein described and illustrated in order to explain the nature of the invention may be made by those skilled in the art within the principles and scope of the invention.

What we claim is:

1. An apparatus for maintaining and inspecting a dockside container crane used for loading and unloading standard ISO containers between ground transport vehicles and cargo ships, said apparatus comprising:

a container having substantially the same dimensions as a standard ISO container, said container providing storage for support equipment necessary for maintaining and inspecting said crane;

first and second cantilevered base platforms rigidly attached to a lowermost portion of opposite ends of said container, respectively;

first and second rotatable turrets, said first and said second rotatable turrets mounted respectively on a surface of said first and a surface of said second cantilevered platforms;

first and second telescopic booms, said first telescopic boom having one end secured to said first turret, said second telescopic boom having one end secured to said second turret;

first and second work platforms, said first work platform connected to the other end of said first telescopic boom; said second work platform connected to the other end of said second telescopic boom; and first and second control means, said first control means located on said first work platform, said second control means located on said second work platform, said first and second control means for permitting operators located on said first and second work platforms, respectively, to position their respective work platforms at desired locations relative to said dockside container crane, via selective rotation of said first and second rotatable turrets, respectively, and selective extension and retraction of said first and second telescopic booms, repsectively;

said apparatus being liftable by said crane to a desired operating position via attachment of a standard container spreader to said crane, said standard container spreader being operable to securely grasp said container such that said apparatus at said operating position is operable for positioning said first and second work platforms over a range of different work locations relative to said crane, said crane being operable to reposition said apparatus for obtaining another range of different work locations for said first and said second work platforms relative to said crane.

2. The apparatus of claim 1, further comprising means for attaching said container and cantilever platforms to a standard ISO container chassis for ground transportation.

3. An apparatus for maintaining and inspecting a crane, said apparatus comprising:

aerial work platform means including a work platform and control means, said control means for permitting an operator on said work platform to position the same within a range at desired vertical and horizontal coordinate positions relative to the said crane; the crane including means for grasping said apparatus, so as to permit the crane to lift and move said apparatus to a predetermined vertical and horizontal operating position so as to permit extending the range of vertical and horizontal coordinate positions of said aerial work platform means relative to the crane, container means for storing support equipment necessary for maintaining and inspecting the crane, said container means being fixedly secured to said aerial work platform means;

an additional aerial work platform means, said additional aerial work platform means being fixedly secured to said container means, the former including another work platform and another control means, for permitting an operator on said another work platform to position the later at a desired vertical and horizontal coordinate position relative to said crane over a range of coordinate positions different at any given time from said work platform of said first aerial work platform means; and said aerial platform means and said additional aerial platform means each including means providing for easy attachment or detachment of their respective work platforms therefrom, said work platforms being storable in said container means during either non-use and transport of said apparatus.

4. The apparatus of claim 3, wherein said container means has two ends, said aerial work platform means being fixedly secured to one end of said container means, said additional aerial work platform means being fixedly secured to the other end of said container means.

5. The apparatus of claim 3, wherein said aerial platform means and said additional aerial platform means each includes means providing for easy attachment or detachment of this respective work platforms therefrom, said work platforms being storable in said container means during either non-use and transport of said apparatus.

6. An apparatus for facilitating the maintenance and inspection of one or more relatively large cranes including grasping means attached to the crane for grasping a container so as to permit the crane to lift the container, comprising:

container means for storing equipment necessary for the inspection and maintenance of said crane; and boom lift means rigidly attached to one end of said container, said first boom lift means including an associated work platform, said boom lift means for positioning said associated work platform at desired horizontal and vertical coordinates within a range of such coordinates relative to portions of the crane, the positioning range being extended, via operation of the crane for lifting and prepositioning said apparatus at various work locations relative to the crane.

7. The apparatus of claim 6 further comprising:

an additional boom lift means rigidly attached to another end of said container distal to said end of said container, said additional boom lift means including an associated work platform, said additional boom lift means for positioning said associated work platform at desired horizontal and vertical coordinates within a range of such coordinates relative to portions of the crane, the coordinate positioning ranges for each of said work platforms being different.

8. The apparatus of claim 6, wherein said boom lift means further comprising control means located on the associated work platform, for permitting an operator on the associated said work platform to control the operation of said boom lift means for positioning the associated said work platform.

9. The apparatus of claim 7, wherein said additional boom lift means further comprising control means located on the associated said work platform, for permitting an operator on the associated said work platform to operate said additional boom lift means for positioning the associated said work platform.

10. The apparatus of claim 8, wherein said boom lift means further comprises:

turret means, said turret means for moving said work platform associated therewith along a circular path in a horizontal plane; and telescopic boom means, said telescopic boom means being connected between said turret means and said work platform for moving said work platform along a circular path in a vertical plane, the length of said boom means being controllable within a range for setting the radius of said circular path.

11. The apparatus of claim 9, wherein said additional boom lift means further comprises:

turret means, said turret means for moving said work platform associated therewith along a circular path in a horizontal plane; and telescopic boom means, said telescopic boom means being connected between said work platform associated with said additional boom lift means and said turret means for moving such said work platform along a circular path in a vertical plane, the length of said additional boom means being controllable within a range for setting the radius of said circular path.

12. The appratus of claim 6, wherein said crane consists of a dockside container crane for moving ISO containers to and from cargo ships, said container being substantially a conventional ISO container, and said grasping means being a conventional spreader for attachment to ISO containers.

13. The apparatus of claim 6, further comprising means for detaching said work platform from said boom lift means so as to permit said work platform to be stored in said container during non-use and transport of said apparatus.

14. The apparatus of claim 7, further comprising means for detaching said work platform from the associated said additional boom lift means so as to permit such said work platform to be stored in said container during non-use and transport of said apparatus.

15. An apparatus for maintaining and inspecting a crane, said apparatus comprising:

aerial work platform means including a work platform and control means, said control means for permitting an operator on said work platform to position the same within a range at desired vertical and horizontal coordinate postions relative to the said crane; the crane including means for grasping said apparatus, so as to permit the crane to lift and move said apparatus to a predetermined vertical and horizontal operating position so as to permit extending the range of vertical and horizontal coordinate positions of said aerial work platform means relative to the crane, said aerial work platform including means for permitting detachment of said work platform therefrom; and container means for storing support equipment necessary for maintaining and inspecting the crane, said container means being fixedly secured to said aerial work platform means, said work platform being storable in said container means during transport of said apparatus.

* * * * *